US008651792B2

(12) United States Patent
Friesen

(10) Patent No.: US 8,651,792 B2
(45) Date of Patent: Feb. 18, 2014

(54) PORTABLE SILO WITH ADJUSTABLE LEGS

(76) Inventor: Henry Friesen, Winkler (CA)

( * ) Notice: Subject to any disclaimer, the term of this patent is extended or adjusted under 35 U.S.C. 154(b) by 215 days.

(21) Appl. No.: 13/027,580

(22) Filed: Feb. 15, 2011

(65) Prior Publication Data

US 2011/0255941 A1 Oct. 20, 2011

Related U.S. Application Data

(60) Provisional application No. 61/324,850, filed on Apr. 16, 2010.

(51) Int. Cl.
*B65D 90/14* (2006.01)
*B65D 88/30* (2006.01)

(52) U.S. Cl.
USPC ..... 414/332; 414/919

(58) Field of Classification Search
CPC ..... B60P 1/00; B65D 88/26; B65D 88/30; B65D 90/12; B65D 90/14; B65G 7/00; Y01S 414/132
USPC ..... 212/302, 303, 304, 305; 220/216, 628, 220/629, 638; 222/460, 461, 462; 414/332, 414/919
See application file for complete search history.

(56) References Cited

U.S. PATENT DOCUMENTS

| | | | | | |
|---|---|---|---|---|---|
| 2,233,005 | A * | 2/1941 | Garlinghouse | ..... | 222/608 |
| 2,606,676 | A * | 8/1952 | Dempster | ..... | 414/469 |
| 3,985,254 | A * | 10/1976 | Grandury | ..... | 414/498 |
| 3,987,563 | A * | 10/1976 | Baur | ..... | 37/345 |
| 4,496,062 | A * | 1/1985 | Gattu et al. | ..... | 212/302 |
| 4,536,009 | A * | 8/1985 | Ashworth | ..... | 280/755 |
| 4,943,200 | A * | 7/1990 | Edwards et al. | ..... | 414/332 |
| 7,341,164 | B2 * | 3/2008 | Barquist et al. | ..... | 220/629 |
| 7,364,044 | B2 * | 4/2008 | Hinata | ..... | 212/277 |
| 8,181,811 | B1 * | 5/2012 | Blake | ..... | 220/475 |

FOREIGN PATENT DOCUMENTS

CA 2600216 3/2009

* cited by examiner

*Primary Examiner* — Saul Rodriguez
*Assistant Examiner* — Brendan Tighe
(74) *Attorney, Agent, or Firm* — Adrian D. Battison; Ade & Company Inc.

(57) ABSTRACT

A portable storage silo includes a cylindrical tank of a height of the order of 45 feet and a diameter of the order of 13 feet with a filling opening at a top of the tank. The tank is raised from the ground on legs which extend to a base holding a discharge opening above the ground. The base has a transverse dimension roughly equal to that of the tank so that it is unstable in uneven terrain and four stabilizer arms are connected to the base at spaced positions around the base. Each stabilizer arm is movable from a first retracted position raised from the base to a second extended position extending outwardly to respective side of the base for stabilizing the base against tilting and is movable about an upstanding axis at the base so as to move the arm so that its angle around the base is adjustable.

12 Claims, 3 Drawing Sheets

PORTABLE SILO WITH ADJUSTABLE LEGS

This application claims the benefit under 35 USC 119 of Provisional Application Ser. No. 61/324,850 filed Apr. 16, 2010.

This invention relates to a portable silo for storing particulate material which is portable so that it can be moved to a temporary location and includes legs which are adjustable so that the silo can be mounted in stable position.

BACKGROUND OF THE INVENTION

In Canadian application Serial No: 2,600,216 of Herman published Mar. 4, 2009 is disclosed a silo or tank which is cylindrical and stands up from a base to a raised upper end at which it can be filled. Such tanks can hold up to 250 tons of a particulate material such as sand. The main point concerning the Herman tank is that it is portable and includes a coupling for attachment to a trailer so that it can be moved to a temporary location.

Often such tanks are mounted on rig mats at a work site or on other unstable base support. As the mounting is temporary, there is no possibility for foundation work to hold the tank stable.

As such tanks contain large amounts of material they apply significant force to the base on which they stand and also the consequences of instability leading to toppling are severe.

SUMMARY OF THE INVENTION

It is one object of the invention to provide an improved silo which has an improved stability.

According to one aspect of the invention there is provided a portable storage silo comprising:

a tank having a peripheral wall, a top wall and a bottom wall;

a filing opening at or adjacent a top of the tank;

a discharge opening at or adjacent a bottom of the tank;

a support assembly for holding the tank with the bottom wall raised from the ground such that the discharge opening is raised for discharge into a receptacle at the ground;

the support assembly including a base for resting on the ground;

the base including a plurality of stabilizer arms connected to the base and located at spaced positions around the base;

each stabilizer arm being movable from a first retracted position raised from the base to a second extended position extending outwardly to respective side of the base for stabilizing the base against tilting.

Preferably the arms are movable to the retracted position in which they extend generally along the peripheral wall of the tank.

Preferably each arm is movable about an upstanding axis at the base so as to move the arm so that its angle around the base is adjustable.

Preferably each arm is movable from a position in which the arm is radial to a central vertical axis of the base.

Preferably there are four arms and each is movable through an angle of 90 degrees from a first position in which it is parallel to an arm on one side to a second position in which it is parallel to an arm on the other side.

Preferably the base has an outer peripheral edge with a transverse dimension approximately equal to that of the tank and the arms extend outwardly from the outer peripheral edge.

Preferably each arm includes a brace extending from the base to the arm, the brace being movable from a position lifting the arm to the retracted position to a position extending downwardly and outwardly to locate the arm in the extended position.

Preferably the brace includes an elbow allowing it to be folded at the elbow.

Preferably there is provided an actuator for driving folding of the brace to effect movement of the arm.

Preferably the tank has a height greater than 30 feet and preferably greater than 40 feet.

Preferably the tank has a transverse dimension less than 15 feet and preferably of the order of thirteen feet.

Preferably the tank is cylindrical.

Preferably the base includes a plurality of upstanding support legs from the ground to the peripheral wall of the tank.

Preferably the support legs are connected to and extend along the peripheral wall of the tank.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
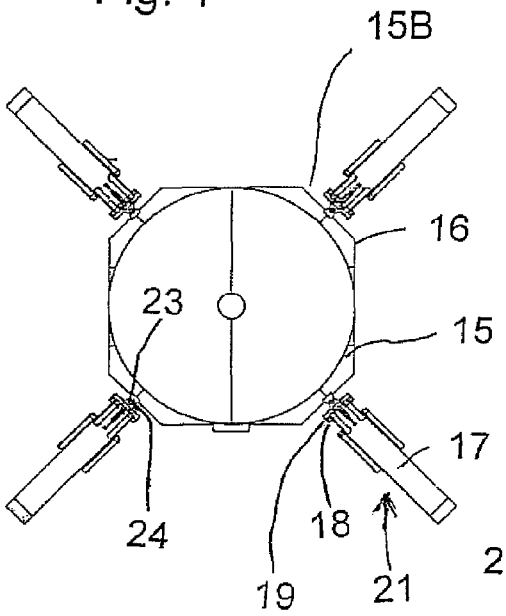
FIG. 1 is a top plan view of a silo according to the present invention with the stabilization arms extended and radial.

The portable storage silo includes a cylindrical tank 10 having a peripheral wall 11, a top wall 12 with a filler opening 12A and a bottom wall 13 with a discharge opening at or adjacent a bottom of the tank.

The tank has a height greater than 30 feet and preferably greater than 40 feet and a diameter less than 15 feet and preferably of the order of thirteen feet which allows it to be portable on a flat bed trailer which is the maximum allowing road transport.

A support assembly 14 is provided for holding the tank with the bottom wall raised from the ground such that the discharge opening is raised for discharge into a receptacle at the ground. Thus when standing it is relatively unstable due to the high weight contained and the great height relative to width.

The support assembly 14 includes a base 15 for resting on the ground. The base defines a ring 15 with an outer peripheral edge 16 with a transverse dimension approximately equal to that of the tank so that is also transportable as part of the same dimension.

The base includes a plurality of upstanding support legs 40 extending from the ring 15 at the ground to the peripheral wall of the tank to support the tank raised from the ring. The support legs are connected to and extend along the peripheral wall of the tank to a position adjacent the top of the tank to provide additional connection to and structural strength for the tank.

The ring carries a plurality, preferably four, of stabilizer arms 17 connected to the base and located at spaced positions around the base. The ring has four diagonal side edges 15B and each stabilizer arm is attached at a respective one of the diagonal side edges so as to be spaced at 90 degrees around the periphery of the tank.

Figure 2:
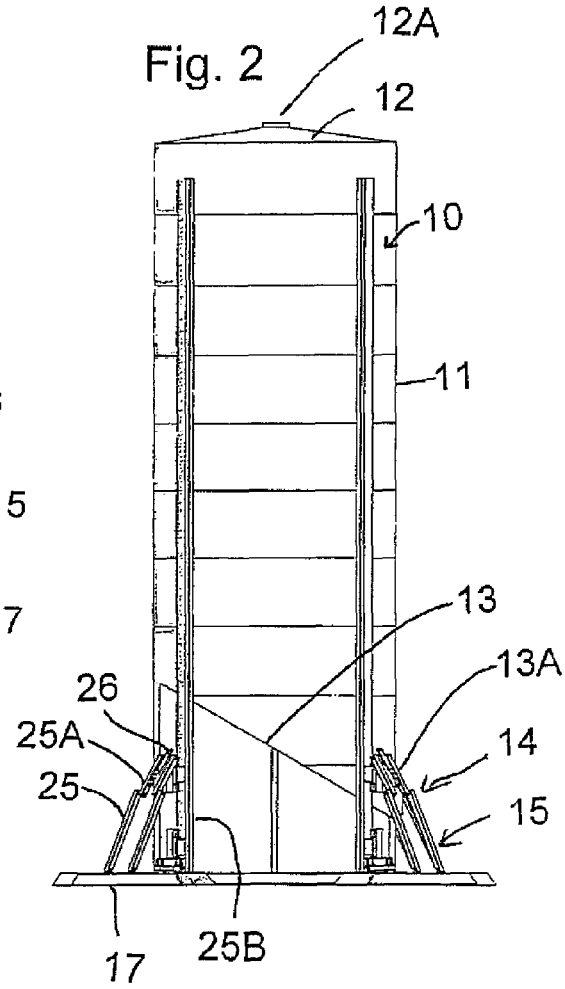
FIG. 2 is a side elevational view of the tank of FIG. 1 showing the stabilization arms extended.
Figure 3:
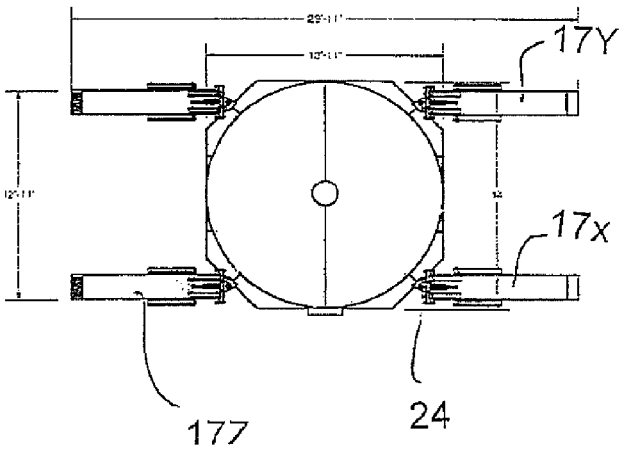
FIG. 3 is a top plan view of the tank of FIG. 1 showing the stabilization arms extended and parallel.
Figure 4:
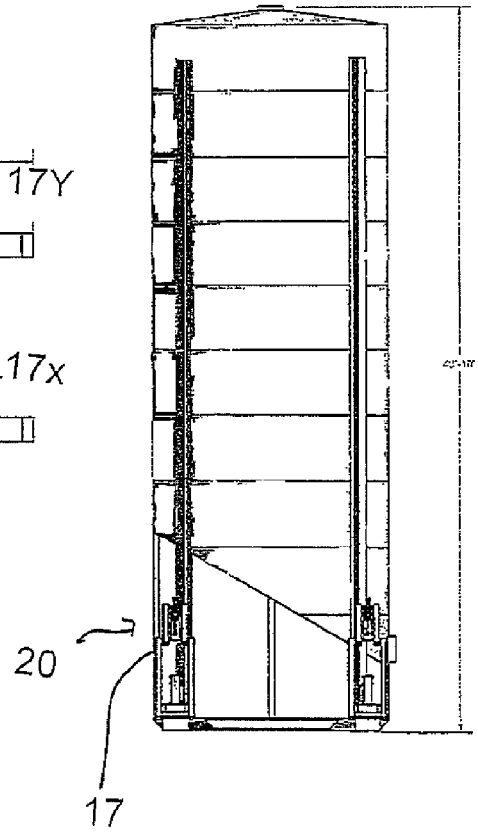
FIG. 4 is a side elevational view of the tank of FIG. 1 showing the stabilization arms retracted.
Figure 5:
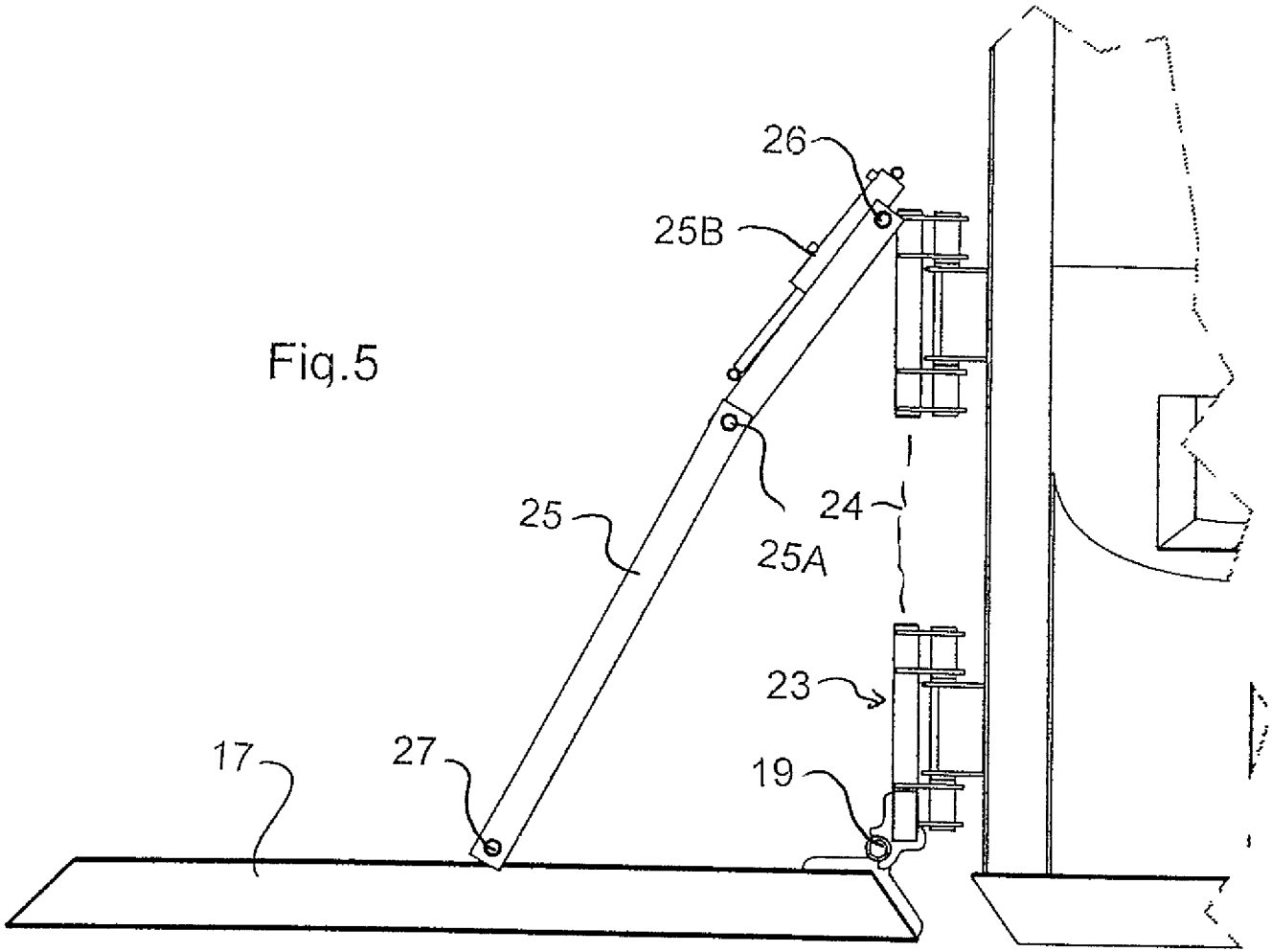
FIG. 5 is an isometric view of the tank of FIG. 1 showing on enlarged scale one stabilization arm.

Each stabilizer arms is mounted on a pivot bracket 18 so that it is movable by pivotal movement about a horizontal axis 19 into a first retracted position 20 shown in FIG. 4 where it is raised from the base vertically upwardly so as to lie in the common periphery of the base and tank for transport. Each stabilizer arms is movable to a second extended position 21 shown in FIG. 2 extending outwardly to respective side of the base for stabilizing the base against tilting. Each arm is also mounted on a second pivot bracket 23 so as to be movable about an upstanding axis 24 at the base so as to move the arm so that its angle around the base is adjustable. Thus each arm is movable from a position in which the arm is radial to a central vertical axis of the base as shown in FIG. 1 and is movable through an angle of 90 degrees from a first position in the arm 17X is parallel to an arm 17Y on one side as shown in FIG. 3 to a second position in which it is parallel to an arm 17Z on the other side.

Each arm includes a brace 25 extending from the base at a pivot point 26 to a bottom pivot point 17 at the arm 17, the brace being movable from a position lifting the arm to the retracted position shown in FIG. 4 to the position extending downwardly and outwardly to locate the arm in the extended position shown in FIG. 1. In order to effect this motion, the brace includes an elbow 25A allowing it to be folded at the elbow by an actuator or hydraulic cylinder 25B extending along the brace from the upper end to a crank (not shown) at the elbow for driving folding of the brace to effect movement of the arm. The upper end of the brace is also mounted on pivot bracket 23A aligned with the bracket 23 and defining the common axis 24 therewith so that both the brace and the arm 17 pivot around the axis 24 to provide the angular adjustment of the arm.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A portable storage silo comprising:

a tank having a peripheral wall defining a circular outer periphery surrounding a longitudinal axis of the tank, a top wall and a bottom wall;

the circular outer periphery having an outer diameter less than 15 feet so as to allow the tank to be portable on a flat bed trailer;

a filling opening at or adjacent a top of the tank;

a discharge opening at or adjacent a bottom of the tank;

a support assembly for holding the tank with the bottom wall raised from the ground such that the discharge opening is raised for discharge into a receptacle at the ground;

the support assembly including a base arranged for resting on the ground to support the tank standing upwardly from the ground;

the base being fixed relative to the tank so that the base is fixed in a radial plane of the longitudinal axis of the tank;

the base defining an outer peripheral edge with transverse dimensions in all directions transverse to the tank which are substantially equal to the diameter of the circular outer periphery and so that the base is also transportable with the tank;

the base including at least four stabilizer arms connected to the base and located at spaced positions around the base;

each stabilizer arm being movable from a first retracted position in which the stabilizer arm is located inside the circular outer periphery for transport with the tank to a second extended position in which the stabilizer arm extends outwardly to a respective side of the base for engaging the ground outwardly of the base while the base sits on the ground for stabilizing the base against tilting;

each stabilizer arm being movable about an upstanding axis at the base parallel to the longitudinal axis of the tank so as to move the stabilizer arm so that an angle of the stabilizer arm around the base is adjustable.

2. The silo according to claim 1 wherein the stabilizer arms are movable to the retracted position in which the stabilizer arms extend generally along the peripheral wall of the tank.

3. The silo according to claim 1 wherein each arm includes a ground engaging surface which is movable upwardly and downwardly.

4. The silo according to claim 1 wherein each stabilizer arm is movable from a position in which the stabilizer arm is radial to the axis of the tank.

5. The silo according to claim 1 wherein there are four stabilizer arms and each is movable through an angle of 90 degrees from a first position in which it is parallel to a respective one of the stabilizer arms on one side to a second position in which it is parallel to a respective one of the stabilizer arms on the other side.

6. The silo according to claim 1 wherein each stabilizer arm includes a brace extending from the base to the stabilizer arm, the brace being movable from a position lifting the stabilizer arm to the retracted position to a position extending downwardly and outwardly to locate the stabilizer arm in the extended position.

7. The silo according to claim 6 wherein the brace includes an elbow allowing it to be folded at the elbow.

8. The silo according to claim 6 wherein there is provided an actuator for driving folding of the brace to effect movement of the stabilizer arm.

9. The silo according to claim 1 wherein the tank has a height from the base greater than 30 feet and preferably greater than 40 feet.

10. The silo according to claim 1 wherein the tank is cylindrical along its full length.

11. The silo according to claim 1 wherein the base includes a plurality of upstanding support legs extending from the ground to the peripheral wall of the tank.

12. The silo according to claim 11 wherein the support legs are connected to and extend along the peripheral wall of the tank.

* * * * *